US007922102B2

(12) United States Patent
Wirthwein et al.

(10) Patent No.: US 7,922,102 B2
(45) Date of Patent: Apr. 12, 2011

(54) SUPPORT POINT AND FASTENING FOR RAILS ON A WOODEN TIE

(75) Inventors: Udo Wirthwein, Creglingen (DE); Joachim Süss, Dresden (DE)

(73) Assignee: Wirthwein AG, Creglingen (DE)

( * ) Notice: Subject to any disclaimer, the term of this patent is extended or adjusted under 35 U.S.C. 154(b) by 0 days.

(21) Appl. No.: 12/481,856

(22) Filed: Jun. 10, 2009

(65) Prior Publication Data

US 2009/0302126 A1 Dec. 10, 2009

(30) Foreign Application Priority Data

Jun. 13, 2008 (DE) ..... 10 2008 028 093

(51) Int. Cl.
*E01B 9/00* (2006.01)

(52) U.S. Cl. ..... 238/349; 238/286; 238/264; 238/269; 238/270; 238/308

(58) Field of Classification Search ..... 238/286, 238/264, 269, 265, 270, 273, 287, 294, 295, 238/297, 298, 299, 308, 377, 366, 370, 371, 238/375

See application file for complete search history.

(56) References Cited

U.S. PATENT DOCUMENTS

| | | | | | |
|---|---|---|---|---|---|
| 3,517,883 | A * | 6/1970 | Holstein | 238/346 |
| 3,519,205 | A * | 7/1970 | Monclin et al. | 238/338 |
| 3,987,962 | A * | 10/1976 | Robbins | 238/287 |
| 4,494,695 | A * | 1/1985 | Sonneville | 238/265 |
| 4,632,307 | A * | 12/1986 | Weber | 238/265 |
| 4,819,869 | A * | 4/1989 | Matlock | 238/298 |
| 4,907,740 | A * | 3/1990 | Oberweiler et al. | 238/283 |
| 5,096,119 | A * | 3/1992 | Schultheiss et al. | 238/349 |
| 5,738,278 | A * | 4/1998 | Franz et al. | 238/377 |
| 5,758,821 | A * | 6/1998 | Wirthwein et al. | 238/366 |
| 6,257,495 | B1 * | 7/2001 | Eisenberg | 238/349 |
| 6,471,139 | B1 * | 10/2002 | Bruder et al. | 238/283 |
| 6,880,764 | B2 | 4/2005 | Schwarzbich | 238/287 |
| 7,156,319 | B2 | 1/2007 | Kowalski | 238/265 |
| 2004/0065746 | A1 * | 4/2004 | Schwarzbich | 238/287 |
| 2008/0105758 | A1 | 5/2008 | Schwiede et al. | 238/349 |
| 2009/0302126 | A1 | 12/2009 | Wirthwein et al. | 238/349 |

FOREIGN PATENT DOCUMENTS

| | | | |
|---|---|---|---|
| DE | 8304915 | U1 | 6/1984 |
| DE | 3715784 | A1 | 11/1988 |
| WO | WO 2005073466 | A1 * | 8/2005 |

* cited by examiner

*Primary Examiner* — S. Joseph Morano
*Assistant Examiner* — Jason C Smith
(74) *Attorney, Agent, or Firm* — Paul & Paul

(57) ABSTRACT

The invention relates to a rail support point for a rail-guided vehicle for anchoring in a wooden tie, including a plate as a support for the rail, which plate is anchored on both sides of the rail by means of fastening bolts that pass through the plate, the plate having on its bottom side collars that surround the fastening bolts and that engage in correspondingly shaped depressions in the wooden tie, the plate being configured as a ribbed plate having raised ribs that are arranged lateral to the rail foot and that guide the latter and being made of plastic, and the collar being embodied as a slitted ring. Also disclosed is a rail fastening using the rail support.

18 Claims, 2 Drawing Sheets

SUPPORT POINT AND FASTENING FOR RAILS ON A WOODEN TIE

BACKGROUND OF THE INVENTION

The invention relates to a rail support point for a rail-guided vehicle for anchoring in a wooden tie, including a plate as a support for the rail, which plate is anchored on both sides of the rail by means of fastening bolts that pass through the plate, the plate having on its bottom side collars that surround the fastening bolts and that engage in correspondingly shaped depressions in the wooden tie, and relates to a rail fastening using the rail support point.

In mining, rail tracks are frequently placed on wooden ties. German utility models 1534087 U1, 1674890 U1, 1748635 U1, and German document DAS 1117626 depict rail fastenings on wooden ties in which the rails are held by a steel plate on only one side of the rail foot and on the other side are pressed down on the rail foot by a bolt. On the top side of the wooden tie, the bore for the bolt has a depression into which a collar of the steel plate used for the rail fastening can be inserted so that the steel plate is held in a positive fit at least on one side of the wooden tie.

Depicted in DE 37 15 784 A1 is an improved steel plate of the type described in the foregoing in which the steel plate is fastened to the wooden tie by three bolts and the rails are held on the steel plate in the manner described in the foregoing by an additional threaded connection.

Known from German utility model 7533044U1 is an anchor that has a sharp-edged profile and that, due to its polygonal exterior shape, has a secure seat in a bore of a wooden tie. The anchor is also slitted in the longitudinal direction so that a tie bolt that is to be screwed in has a secure seat and can be screwed in and out multiple times.

Known from DE 83 04 915 U1 is a spreading anchor that is for rehabilitating older rail ties and that can be inserted into the wooden tie from below and is otherwise constructed in a manner similar to the anchor described in the foregoing. For the rail support point, the rail fastening depicted together with the anchor can be placed on a ribbed plate using another cover disk and the rail foot is held down using a steel spring.

Proceeding from the prior art in accordance with DE 37 15 784 A1, the underlying problem of the invention is to create a non-elastic rail fastening having only two bolts per support point and to hold the rail foot resiliently, whereby the rail fastening is to be used for wooden ties and is to be commensurately cost efficient.

SUMMARY OF THE INVENTION

The problem is solved in accordance with the invention recited by claims 1 and 7. Specifically, claim 1 recites: Rail support point for a rail-guided vehicle for anchoring in a wooden tie, including a plate as a support for the rail, which plate is anchored on both sides of the rail by means of fastening bolts that pass through the plate, the plate having on its bottom side collars that surround the fastening bolts and that engage in correspondingly shaped depressions in the wooden tie, characterized in that the plate is configured as a ribbed plate (1) having raised ribs (11) that are arranged lateral to the rail foot (SF) and that guide the latter and is made of plastic, and the collar (14) is embodied as a ring having a slit (16).

Claim 7 recites: Rail fastening on wooden ties having a rail support point in accordance with the foregoing is characterized in that for anchoring said fastening bolt (4) an anchor (3, 30, 300) made of plastic is arranged in said wooden tie (2) underneath said collar (14) and said fastening bolt (5, 50), by means of a steel spring (4), known per se, clamps the rail foot (SF) via an intermediate layer (ZW) to the rail support point or said ribbed plate (1).

The first solution includes a rail support point for a rail-guided vehicle for anchoring in a wooden tie, including a plate as a support for the rail, which plate is anchored on both sides of the rail by means of fastening bolts that pass through the plate, the plate having on its bottom side collars that surround the fastening bolts and that engage in correspondingly shaped depressions in the wooden tie, the plate being configured as a ribbed plate having raised ribs that are arranged lateral to the rail foot and that guide the latter and being made of plastic, and the collar being embodied as a slitted ring.

Using these measures both provides the advantages of conventional ribbed plates made of steel while also ensuring that the ribbed plate in the wooden tie has a positive fit in the predrilled holes for the fastening bolts. The plastic material for the ribbed plate, preferably a high-strength polyamide, is simple to extrude and is inexpensive. The gap in the collar is widened when the fastening bolt is inserted so that the ribbed plate also has a friction fit in the depressions. This ensures that the lateral forces exerted on the rails by the hunting oscillation of the rail-guided vehicles are introduced to the wooden tie via the ribbed plate; the fastening bolt is not loaded by lateral bending forces.

For the purposes of simple and rapid, cost-effective assembly, the rail support point, and thus also the ribbed plate, should have only one through-hole and consequently only one collar for each fastening bolt. Since the collar is preferably configured such that its inner diameter is smaller than the outer diameter of the corresponding sections of the fastening bolt that comes into contact with the collar, the collar is widened by the gap or the slit and thus presses into the depression in the wooden tie.

The ribbed plate itself should also have a counterbearing for supporting the spring for fastening the rail, more specifically for holding the rail foot down.

If the ribbed plate is made of polyamide 6, for instance, it can be produced easily using conventional extruders and is consequently very cost-effective.

The second solution includes a rail fastening on wooden ties having a rail support point using the inventive ribbed plate and the corresponding arrangement, an anchor made of plastic being arranged in the wooden tie underneath the collar for anchoring the fastening bolt and the fastening bolt, by means of a steel spring, known per se, clamping the rail foot via an intermediate layer to the rail support point.

The anchor can thus be inserted into the wooden tie such that the collar still exerts pressure on it so that it has a secure seat in the wooden tie. As is known from the prior art, the spreading anchor can be provided with sharp exterior profiles that work themselves into the wood of the wooden tie and there provide a secure seat for the fastening bolt once it is screwed in. Because of this pressure into the wood from the spreading anchor, the fastening bolt can also be unscrewed and screwed back in multiple times.

In another version, the wooden tie can also be provided with an anchor that has been pressed in and that has a centering unit that widens, i.e., flares outwardly, in the downward direction, i.e., at the lower end. This means that the anchor is pressed into the wooden tie from below, so that it then naturally is pressed in only to the elevation of the collar, but not necessarily that deep. Because of its centering unit on the end of the anchor, that is, in the area of the base of the wooden tie, it is assured that the anchor will remain in its position even if the fastening bolt is screwed in and out multiple times.

Instead of a symmetrical centering unit, an asymmetrical shape can also be selected for the head of the anchor in order to sink correspondingly into the wooden tie from the bottom side. Instead of conventional tie bolts, in this case it is also possible to employ machine bolts like those known per se from through-connections for switch ties. Such a rail fastening can be used with the inventive ribbed plate, which also have a counterbearing for a conventional spring loop for, for instance, the spring types SKL 1, 14, or 15 used by the Deutsche Bahn AG, so that there are standard components for the rail fastening and it is also possible to create a very cost-effective ribbed plate and a very cost-effective rail support point.

BRIEF DESCRIPTION OF THE INVENTION

Exemplary embodiments shall be used to explain to one skilled in the art the objects, purposes, and advantages of the invention in greater detail, using drawings.

Figure 3:
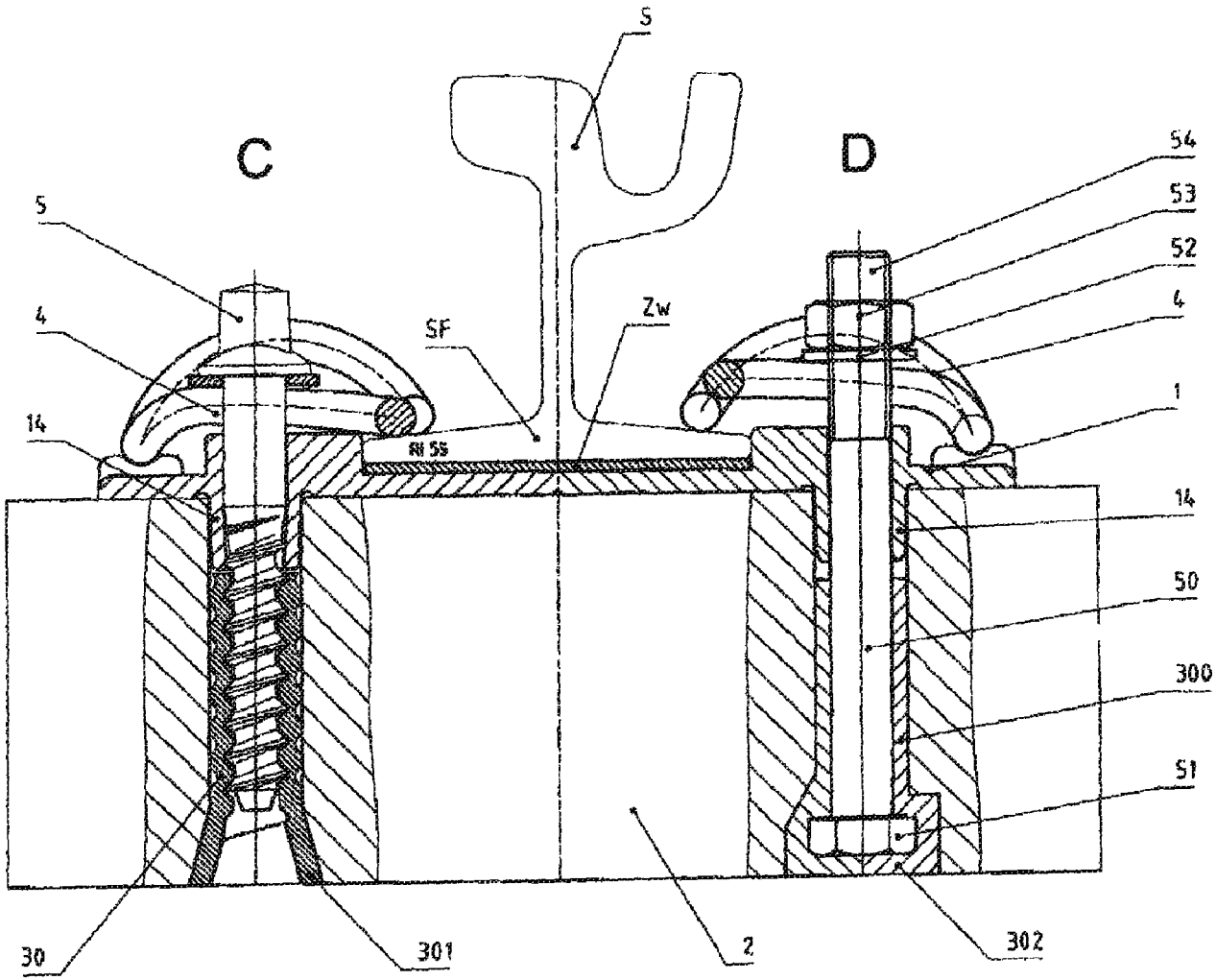

FIG. 3 in the left-hand portion of the drawing depicts a second embodiment of the anchor arrangement in the wooden tie, and in the right-hand portion depicts a third embodiment of the rail fastening in a wooden tie.

DETAILED DESCRIPTION OF THE INVENTION

Figure 1:
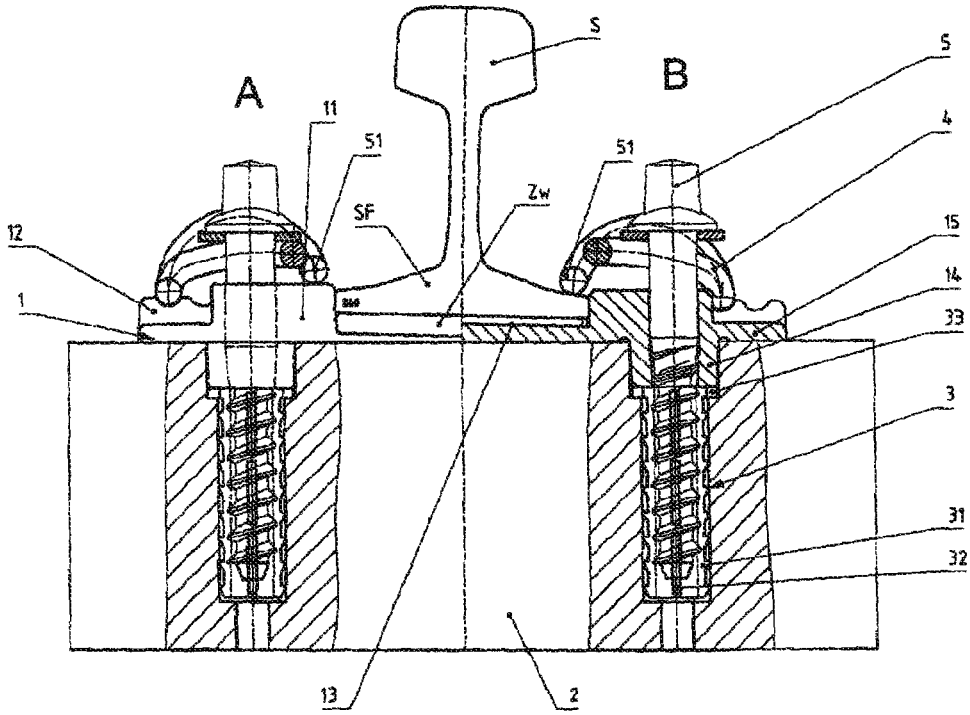
FIG. 1 depicts a first exemplary embodiment of a rail fastening having an inventive rail support point and an anchor arrangement for the fastening bolts.

FIG. 1 depicts a rail S 49 on an inventive ribbed plate (1) upon which the rail foot (SF) rests with an elastic intermediate layer (ZW) made of plastic interposed therebetween. The rail foot is guided laterally by the ribs (11) of the ribbed plate (1). The ribbed plate is disposed on the wooden tie (2). The anchoring of the ribbed plate 1 and the rail S49 can be seen in the section of the tie (2) made of wood that is depicted in cut-away. In a depression in the wooden tie (2), the ribbed plate 1 has an integral collar (14) that projects for a distance into the bore. Beneath the collar 14 is an anchor made of plastic (3), in this case an extruded polyamide anchor, which itself has a collar (33) and sharp-edged profiles (31) on its exterior. Because of this the anchor sits securely in the wooden tie (2) after it has been pressed into the pre-drilled bore. In one embodiment, the ribbed plate (1) together with the anchor (3) can be extruded as an integral piece; in this case the anchor is depicted as an additional component that when fitted from above into the pre-drilled bore exerts pressure on the collar (33) of the anchor (3) using the collar (14) and thus has a secure purchase in the tie (2). No tolerance is depicted here between the supports (13) for the rail foot (SF) and the ribs (11) of the ribbed plate (1); in practice, the rail foot will have slight lateral tolerances and will not be disposed completely on the ribs (11).

On the left-hand side of FIG. 1, Partial Figure A depicts a pre-assembly position for the ribbed plate, including anchor (3) and bolt (5). In this pre-assembly position, the bolt (5) has been screwed in until it exerts slight pressure on the spring (4), the spring curve (51) of which is itself disposed on the rib (11) on the one side and on the other side rests on the back part (15) of the counterbearing (12) arranged for the ribbed plate. The spring arrangement depicted here is known as type SKL 1. However, Type SKL 14 or SKL 15 or another fastening that functions in the same manner may also be used.

In the right-hand side of the drawing, depicted here as Version B of FIG. 1, is the bolt (5) and the spring (4) in their position for use. The spring unit (51) is disposed on the rail foot SF on one side and on another counterbearing on the back part (15) of the ribbed plate, thus holding the rail foot SF down.

Figure 2:
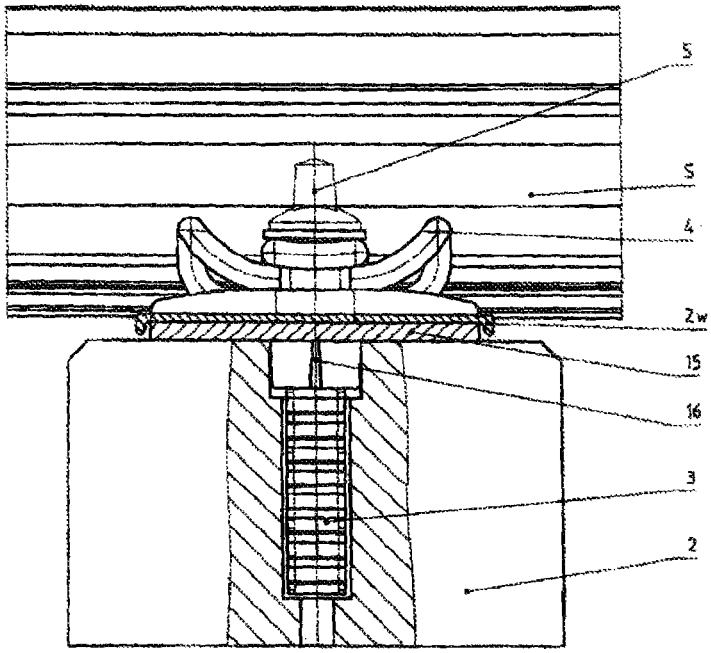
FIG. 2 depicts a side view of the rail fastening, in section, at a fastening bolt.

FIG. 2 provides a side view, also with the wooden tie (2) cut away. This depiction corresponds to Part B in FIG. 1. In this case it can be seen that the collar (14) of the ribbed plate (1) has a gap or slit (16). When the bolt (5) is screwed into its final position, as depicted, this causes the collar (14) to spread and thus the gap (16) opens. The consequence of this is that the collar 14 is additionally fixed in a non-positive fit by the pressure from the bolt 5 and experiences more than just positive fit.

FIG. 3 depicts an alternative rail fastening for an Ri55 grooved rail (S1) using two types of fastenings; in Drawing Part C on the left and in Drawing Part D on the right, each in the fully assembled position with rail foot SF pressed down via spring (4).

In Drawing Part C, beneath the collar 14 the ribbed plate has an anchor (30) that also has a sharp-edged exterior profile. However, in this case the anchor has been pressed into a pre-drilled bore from the bottom side of the wooden tie (2), and has been pressed in until the centering unit (301) is flush with the base of the wooden tie 2.

An anchor (300) having an integrated bolt (50) has also been used from underneath in Drawing Part D. On its bottom end (302) the anchor (300) has an asymmetrical expansion that also receives the polygonal section (51) of the bolt and thus ensures a secure seat in the wooden tie. In terms of the bolt (5), there is a machine thread (54) on the upper end of the wooden tie 2 onto which a washer (52) and a nut (53) can be placed in order to bring the spring (4) into its depicted target position on the rail foot SF. In both of these versions of the anchor, the anchors can be inserted into the wooden tie 2 from below as far as the collar (14) of the ribbed plate 1 permits.

The invention claimed is:

1. Rail support point for a rail-guided vehicle for anchoring in a wooden tie (2), including:

a) plate (1) as a support for the rail (S), b) the plate (1) is anchored on both sides of the rail (S) by means of fastening bolts (5) that pass through the plate (1), c) the plate (1) having on its bottom side collars (14), d) the collars (14) surround the fastening bolts (5), e) the collars (14) engage in correspondingly shaped depressions in the wooden tie (2), f) the collars (14) are embodied as rings having a slit (16), g) the plate (1) is configured as a ribbed plate (1) having raised ribs (11) on its upper side, h) the ribs (11) are arranged lateral to the rail foot (SF), i) the ribs (11) guide the rail foot (SF), and j) the ribbed plated (1) is made of plastic.

2. Rail support point in accordance with claim 1, characterized in that on each side of the rail (S, S1) said ribbed plate (1) has only one through-hole with collars (14) for fastening bolts (5, 50).

3. Rail support point in accordance with claim 1 or 2, characterized in that the inner diameter of said collar (14) of the bottom side of the plate (1) is smaller than the outer diameter of the corresponding section of said fastening bolts (5, 50).

4. Rail support point in accordance with either of foregoing claims 1-2, characterized in that said ribbed plate (1) is embodied in a single integral piece.

5. Rail support point in accordance with either of foregoing claims 1-2, characterized in that said ribbed plate (1) has a rearward counterbearing (12, 15) for supporting a spring (4) for rail fastening.

6. Rail support point in accordance with either of foregoing claims 1-2, characterized in that said ribbed plate (1) comprises the plastic polyamide.

7. Rail fastening in accordance with claim 6, characterized in that said anchor (3, 33) can be subjected to pressure by said collar (14).

8. Rail fastening in accordance with claim 6, characterized in that said anchor (3) is embodied integrally with said ribbed plate (1).

9. Rail fastening in accordance with claim 6, characterized by a spreading anchor (3), having exterior sharp-edged profiles (31).

10. Rail fastening in accordance with claim 6, characterized by an anchor (30, 300) that has been pressed into said wooden tie (2) from below and that has a centering unit that widens in the downward direction.

11. Rail fastening in accordance with claim 6, characterized by an anchor (300) that can be placed with said fastening bolt (5, 50) into said wooden tie (2) from below and that has an asymmetrical end (302) for placing in a correspondingly configured bore in said wooden tie (2).

12. Rail fastening on wooden ties having a rail support point in accordance with either of foregoing claims 1-2, characterized in that for anchoring said fastening bolt (4) an anchor (3, 30, 300) made of plastic is arranged in said wooden tie (2) underneath said collar (14) and said fastening bolt (5, 50), by means of a steel spring (4), clamps the rail foot (SF) via an intermediate layer (ZW) to the rail support point or said ribbed plate (1).

13. A rail support having a pair of support points, for anchoring a rail-guided vehicle rail to a tie, said tie having a bore there through at each support point and a depression in the top of said bore, comprising:

a support plate for supporting said rail, said plate having a pair or collars on its bottom side, said plate collars extending one each into a respective depression;

upstanding ribs on the top side of said plate, said ribs arranged lateral to the rail foot on the back part of said plate;

an anchor received within each said bore below each of said depressions, said anchor having a collar adjacent said depression;

a spring engaging the rail foot and a rib on said plate back part;

a fastening bolt holding said spring to said rail foot and extending through said plate to engage said anchor; and wherein when said bolt is tightened said plate collar is drawn into a friction fit in said depression.

14. The rail support of claim 13, wherein said plate collar is split, said plate collar having an inner diameter smaller than the corresponding section of the fastening bolt in contact therewith, thereby widening said plate collar pressing it into the depression.

15. The rail support of claim 13, wherein said anchor has a collar proximate it top end and sharp edged profiles on its exterior; and wherein when said fastener bolt is tightened said plate collar engage said anchor collar.

16. The rail support of claim 13, wherein said plate and said anchor or made in one piece.

17. The rail support of claim 13, wherein said anchor is flared outwardly at its lower end.

18. The rail support of claim 13, wherein said anchor has a polygonal section and an asymmetrical expansion at its lower end.

* * * * *

UNITED STATES PATENT AND TRADEMARK OFFICE

CERTIFICATE OF CORRECTION

PATENT NO. : 7,922,102 B2
APPLICATION NO. : 12/481856
DATED : April 12, 2011
INVENTOR(S) : Udo Wirthwein and Joachim Suss It is certified that error appears in the above-identified patent and that said Letters Patent is hereby corrected as shown below:

Column 3, line 8, reads "have a counterbearing for a conventional spring loop, for, for"
should read -- has a counterbearing for a conventional spring loop for, for --

Column 4, line 55 claim 1, reads "j) the ribbed plated (1) is made of plastic."
should read -- j) the ribbed plate (1) is made of plastic --

Column 6, line 4 claim 13, reads "pair or collars on its bottom side, said plate collars"
should read -- pair of collars on its bottom side, said plate collars --

Column 6, line 24 claim 15, reads "collar proximate it top end and sharp edged profiles on its"
should read -- collar proximate its top end and sharp-edged profiles on its --

Column 6, line 26 claim 15, reads "plate collar engage said anchor collar."
should read -- plate collar engages said anchor collar. --

Column 6, line 28 claim 16, reads "anchor or made in one piece."
should read -- anchor are made in one piece. --

Signed and Sealed this
Twenty-fourth Day of April, 2012

David J. Kappos

David J. Kappos
*Director of the United States Patent and Trademark Office*